US005207468A

United States Patent [19]

Saulnier et al.

[11] Patent Number: 5,207,468

[45] Date of Patent: May 4, 1993

[54] SELF-ADJUSTING TRANSFORMER SLING

[76] Inventors: Georges Saulnier, 240 Rosaire Street, St-Gabriel-de-Brandon, Quebec G0K 2N0; Mario Saulnier, C.P. 358 Mandeville, Quebec City J0K 1L0, both of Canada

[21] Appl. No.: 888,796

[22] Filed: May 27, 1992

[51] Int. Cl.[5] ..... B66C 1/62

[52] U.S. Cl. ..... 294/67.31; 294/81.21; 294/81.51

[58] Field of Search ..... 294/67.3, 67.31, 67.33, 294/67.5, 81.2, 81.21, 81.3, 81.5, 81.51, 81.54, 110.1

[56] References Cited

U.S. PATENT DOCUMENTS

| | | | |
|---|---|---|---|
| 1,510,176 | 9/1924 | Knight | 294/110.1 |
| 3,010,751 | 11/1961 | Day et al. . | |
| 3,273,931 | 9/1966 | Caldwell et al. | 294/81.2 X |
| 3,549,190 | 12/1970 | Caldwell . | |
| 4,108,485 | 8/1978 | Jennings | 294/67.31 X |
| 4,258,949 | 3/1981 | Keagbine | 294/81.21 |
| 4,373,755 | 2/1983 | Herberholz et al. | 294/81.3 |
| 4,563,031 | 1/1986 | Kishimoto et al. | 294/81.21 |
| 4,693,017 | 9/1987 | Oehler et al. | 294/67.33 X |

FOREIGN PATENT DOCUMENTS

| | | | |
|---|---|---|---|
| 1625804 | 2/1991 | U.S.S.R. | 294/110.1 |
| 8602340 | 4/1986 | World Int. Prop. O. | 294/110.1 |

*Primary Examiner*—Robert P. Olszewski
*Assistant Examiner*—Dean J. Kramer
*Attorney, Agent, or Firm*—Pierre Lespérance; Francois Martineau

[57] ABSTRACT

The sling includes a telescopic compensation bar, provided with two pairs of lever arms pivotally mounted to the opposite ends respectively of the compensation bar. The lever arms pivotally engage at their bottom ends the integral sling hooks of the transformer to be lifted. Each of the two parallel plates of the telescopic bar has an intermediate ovoidal slit, both slits slidingly engaged by a transverse shaft. The shaft depends from a yoke suspended to the hoist gear cable. The two ovoidal slits are not parallel, but rather disposed in X-shaped fashion. Hence, during lift, for a smaller transformer width, the compensation bar will automatically retract to a shorter overall length, so as to automatically and continuously maintain the lateral lever arms tightly and firmly against the transformer, whatever the dimensions of the transformer. Moreover, the greater the transformer weight, the larger the inward bias will be applied by the lever arms against the transformer.

7 Claims, 3 Drawing Sheets

SELF-ADJUSTING TRANSFORMER SLING

FIELD OF THE INVENTION

The invention relates to hoisting sling equipment, particularly such equipment for use with a crane in lifting electrical utility transformers to the top of the electrical line supporting poles.

BACKGROUND OF THE INVENTION

An electrical transformer is a component that consists of two or more coils which are coupled together by magnetic induction, and which is used to transfer electric energy from one or more circuits to one or more other circuits, without change in frequency but usually with changed values of voltage and current. Typically, such a transformer is installed to the top portion of the ground-standing poles supporting electrical lines, beneath the high-voltage lines, near houses. Indeed, high voltage current is more efficient where transport of electricity over long distances is required, yet, lower voltage is required for domestic use, hence the need of such transformers.

These transformers are very heavy, and it is not an obvious task for the utility company workers to install this component to the top of the upright pole. Usually, this is done with a crane provided with a power hoisting gear, coupled to a cable depending from the crane boom. The problem oft encountered is in the way the cable is releasably secured to the transformer body. Indeed, the transformer has an outer housing of smooth, cylindrical shape with transverse sling hooks conventionally provided integrally to the housing, for releasable anchoring of the crane sling cable. It is essential that the transformer be firmly and tightly secured by the cable during its lifting to the top of the pole, yet be easily and quickly released after bolting to the pole body. It is easy to understand the health hazard to the utility workers beneath or around the transformer, should the very heavy transformer accidentally (brutally) release during lift and fall to the ground: lethal impact on the ground, or crane cable whiplash that would hurt the workers around the upstanding transformer and perhaps drive these workers toward and in contact with live, high-voltage electrical lines—another lethal accident. Yet, such accidental disconnection of the crane cable from the transformer is not uncommon, particularly with wear associated with extensive use of the sling. This is because the sling cable tends in use to shear against the top circular rim edge of the cylindrical transformer, particularly so when the transformer sways laterally during lift due to wind or other conditions. Such concern as to cable shearing action is increased by the fact that transformers are not of uniform dimensions (particularly not of uniform diameter) or weight When a cable sling is used for lifting different types of transformers, it will tend not to hold as tightly and as firmly the transformer, when the latter is of relatively small dimensions, or will tend to shear more against the top rim edge, when the transformer is of relatively large dimensions.

U.S. pat. No. 3,010,751 to Day and Berg, and U.S. pat. No. 3,549,190 to Caldwell, each shows a cable sling consisting of a transverse compensation bar provided with load body securing members at its two opposite ends, and means to manually adjust the relative position of the securing members accordingly with the dimensions of the hoisted load. It is understood that one has to manually adjust the sling, each time a new load needs to be connected thereto and lifted—a tedious operation. Moreover, because of the heavy load sustained due to the weight of the heavy hoisted load, there are concerns that the releasable manual locking means (pawl 19 in Day, stopper means 24 in Caldwell) may accidentally release due to sudden jolt associated with unexpected hoist gear pulling speed variations or varying wind conditions. This again would constitute hazardous conditions for the workers.

OBJECTS OF THE INVENTION

The gist of the invention is to provide a transformer sling with means to automatically adjust the sling for perfect fit thereof to transformers of various dimensions.

An object of the invention is to provide the above noted sling, being of low manufacturing cost and of simple use.

An important object of the invention is to address the need for improving safety of maintenance workers of electrical distribution lines of utility companies.

Another object of the invention is to address the problem of preventing entanglement of hoist gear cable with the protruding terminal of the transformer and electrical wires connecting the terminal to the pole supported electrical lines, as the transformer is lifted by the sling.

SUMMARY OF THE INVENTION

Accordingly with the objects of the invention, there is disclosed a self-tightening sling for use in lifting a load with a hoist cable, said sling comprising: (a) an elongated, telescopic, compensation bar; (b) means for suspending said compensation bar in a generally horizontal position the latter means being adapted to be operatively connected to said hoist cable; (c) first and second lever means, to be carried at the two opposite ends respectively of said compensation bar; (d) mounting means for mounting said lever means to said compensation bar opposite ends, for relative movement thereabout; (e) means for releasably interconnecting said lever means to said load, whereby said load remains continuously spaced from said compensation bar; and (f) means cooperating with said compensation bar suspending means for symmetrically varying the length of said compensation bar in proportion to the width of said load under the pulling bias of said hoist cable; wherein said load becomes tightly and firmly secured by said sling lever means, under a biassing force in proportion to the weight of said load.

DETAILED DESCRIPTION OF THE INVENTION

Figure 1:
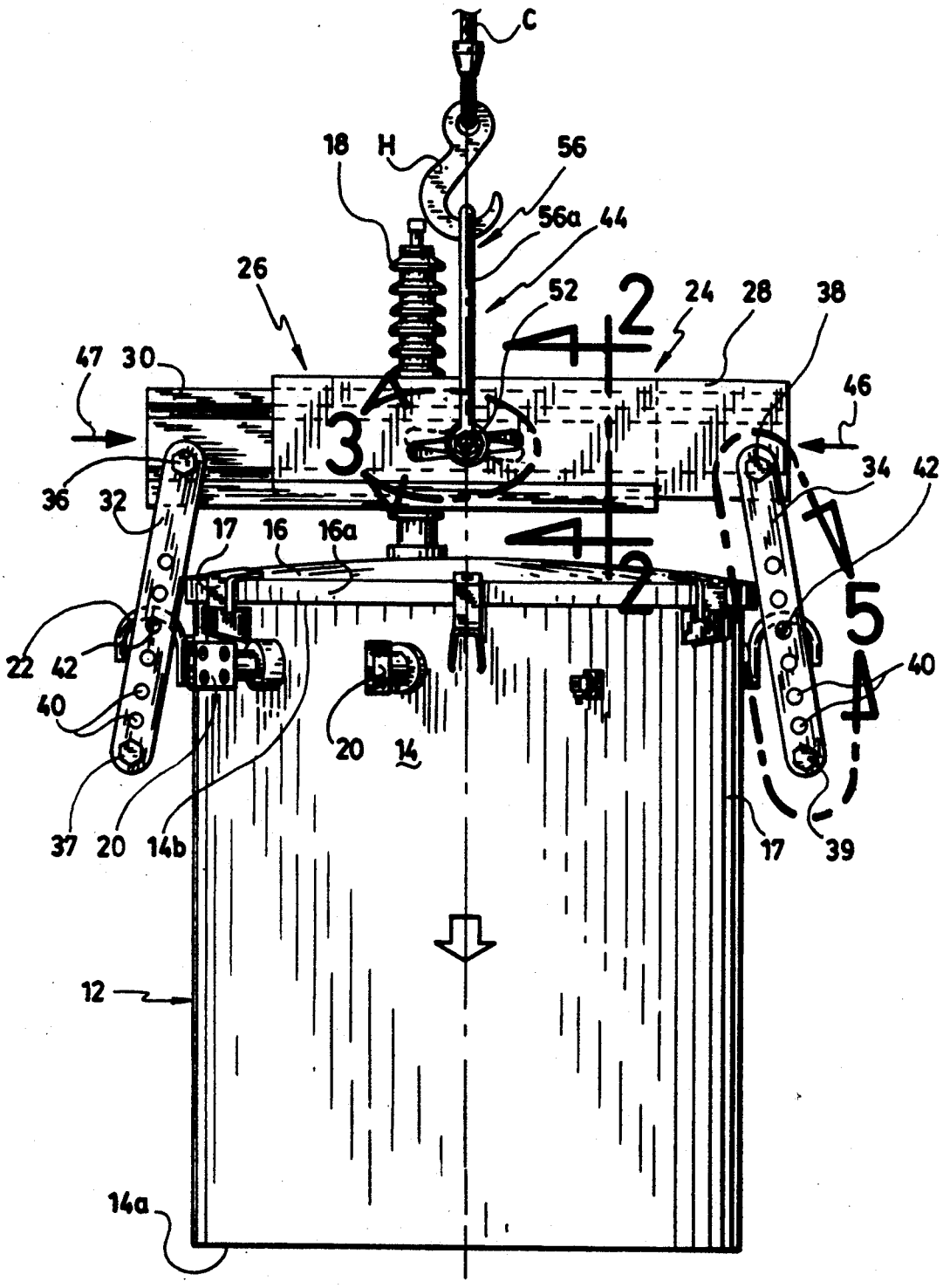
FIG. 1 is an elevational view of a transformer captured by a preferred embodiment of self-adjusting sling according to the invention, and being lifted by a hoist gear cable shown only fragmentarily.

Electrical transformer 12 conventionally includes a number of coils coupled together by magnetic induction, and concealed within a large cylindrical housing 14. Housing 14 is closed at its bottom end 14a and opened at its top mouth 14b. An outwardly convex cylindrical cover 16 with a transverse edgewise flange 16a lockingly seals the cylinder mouth 14b, with releasable latches 17 interconnecting flange 16a with the radially outer rim of housing mouth 14b. A generally cylindrical tube, terminal 18, projects axially through cover 16, being located off-center relative to the central longitudinal axis of cylindrical housing 14. Terminal 18 is to be connected to the main electrical line supported by the electric poles, by connector wires (not shown). Mounting brackets 20 project radially outwardly from housing 14, proximate cover flange 16a, for anchoring the transformer to the upper end of the utility line post. Inversely U-shape sling hooks 22 are also integrally provided to housing 14, radially outwardly therefrom, generally at the same level as brackets 20, for engagement by the sling lines.

According to the invention, there is provided a sling member 24, for holding the transformer 12 during its lifting with a hoisting gear (not shown). Sling member 24 includes a telescopic compensation bar member 26, defining two interengaged, relatively movable, elongated rail members 28 and 30. A pair of parallel, spaced link arms 32, 32 are endwisely interconnected by bolts 36, 37, and another pair of spaced link arms 34, 34 are endwisely interconnected by bolts 38, 39 respectively. Bolts 36, 38 pivot one end of link arms 32, 32 and 34, 34, respectively, to the outer free ends of rail member 28 and 30, respectively,-the latter thus extending between the pair of link arms and constituting link arm spacer members. Pivot axles 36, 38 extend about axes orthogonal to the direction of displacement of rail members 28 and 30. Each link arm 32 and 34 includes a plurality of lengthwisely spaced through-bores 40, for smooth through engagement by a (cylindrical) cotter pin 42 (FIGS. 6–7. The two lock pins 42 engaged through two registering bores of links 32,32 or 34,34 are to engage the bights of the two conventional, inversely U-shape, sling securing hooks 22.

A connector means 44 is mounted transversely to the compensation bar 26 intermediate thereof, for suspending the sling 24 to the hoisting gear cable C, wherein transformer 12 may be lifted via a loop member consisting of compensation bar 26, link arms 32, 34, U-hooks 22, and pins 42.

Figure 2:
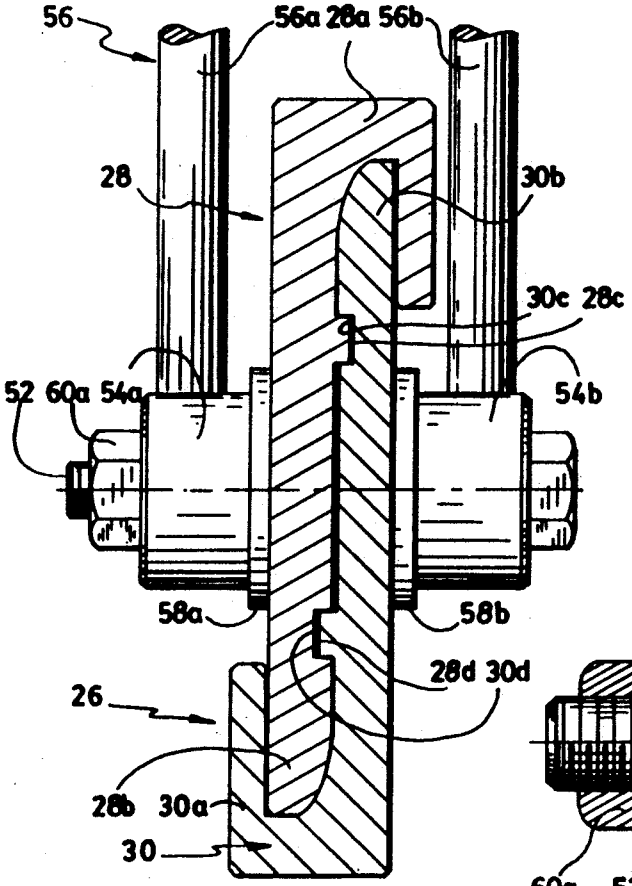
FIG. 2 is an enlarged cross-section of the sling telescopic compensation bar, taken along line 2—2 of FIG. 1.
Figure 5:
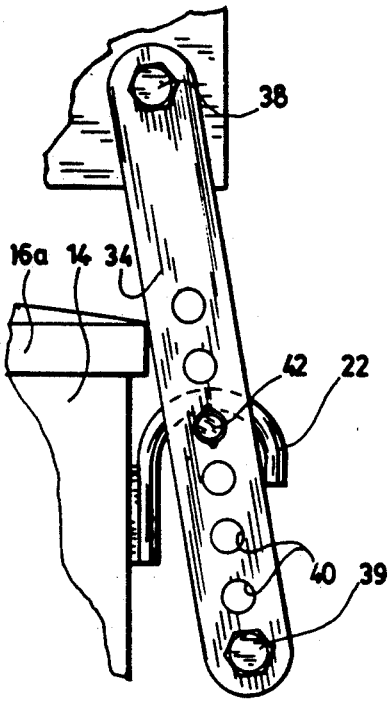
FIG. 5 is an enlarged view of area 5 in FIG. 1.

As best seen in FIG. 2, rail members 28, 30 are mirror images of one another. Each elongated rail member 28, 30, defines a plate provided with a first cross-sectionally U-shape long edge 28a, 30a and a second, opposite, thinner, generally convex long edge 28b, 30b. Thin edge 28b (of one rail number) slidingly engages into the U of enlarged U-shape edge 30a (of the other rail number), and thin edge 30b engages into the U of larger U-shape edge 28a. A transverse ridge 28c engages a transverse groove 30c while a transverse ridge 30d engages a transverse groove 28d, whereby parts 28c, 30c and 30d, 28d form guiding tracks for guiding parallel displacement of adjacent plates 28, 30 relative to one another about the lengthwise axis 46 of plates 28, 30.

Figure 3:
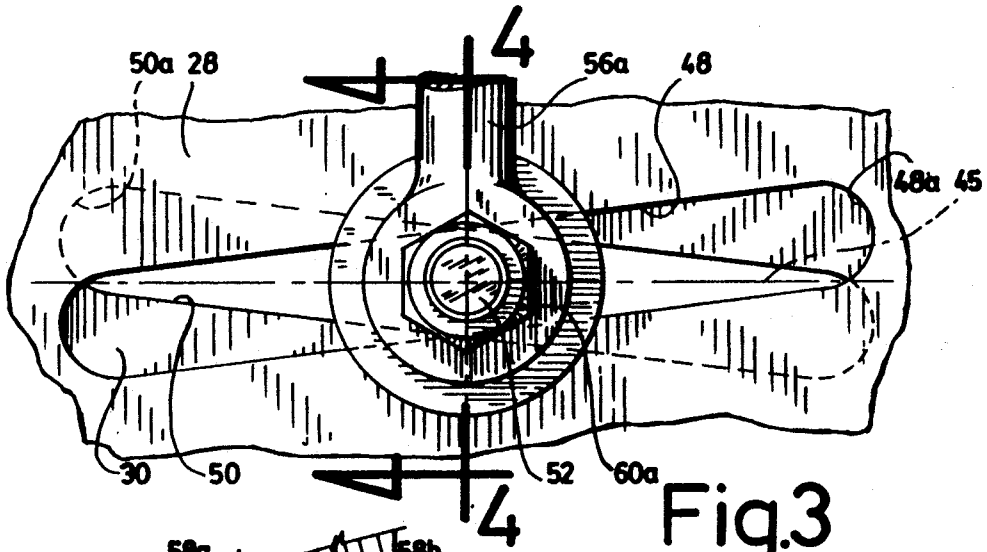
FIG. 3 is an enlarged view of area 3 of FIG. 1.
Figure 4:
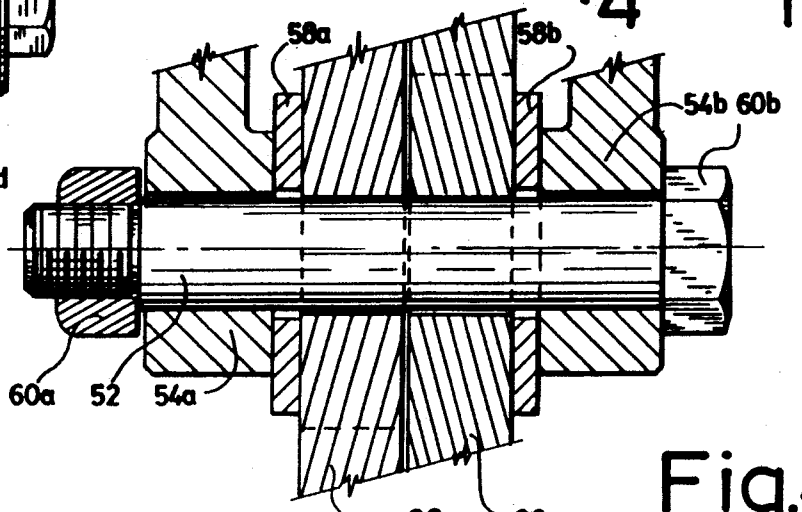
FIG. 4 is a cross-section about line 4—4 of FIG. 3.
Figure 8:
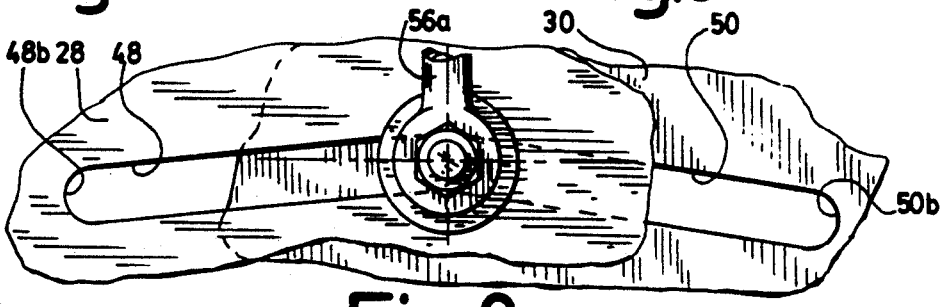
FIGS. 8–8a are fragmentary views similar to FIG. 3, but partly cut away so as to suggest the play of the center lift bolt along the inclined ovoidal slits of the two telescopic members of the sling compensation bar, during self adjustment.
Figure 8A:
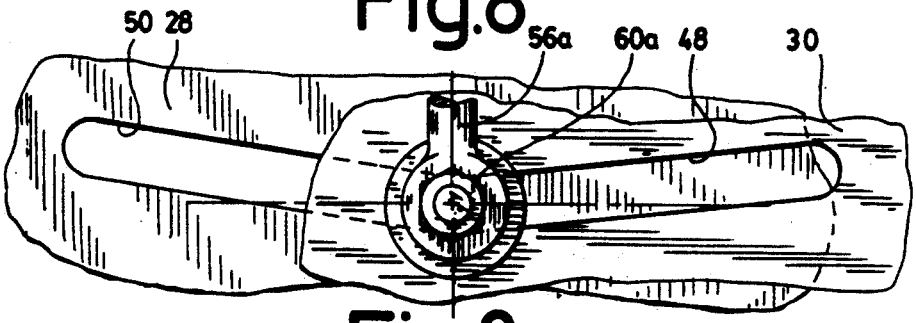

According to the heart of the invention, and as illustrated in FIGS. 3 and 8–8a, the intermediate section of each plate 28, 30 includes an ovoidal slit 48, 50 respectively. Elongated slits 48 and 50 are not coaxial to the lengthwise axes of plates 28, 30. Rather, from the perspective of FIG. 3, elongated slit 48 is upwardly inclined to the right side of the compensation bar, while elongated slit 50 is downwardly inclined to the same right side of the compensation bar, relative to the lengthwise (generally horizontal) axis 45 of compensation bar 26.

The value of the relative acute angle between main axis 45 and the lengthwise axis of ovoidal slit 48 must be equal to that of the angle between axis 45 and the lengthwise axis of the other ovoidal slit 50, for automatic adjustment means 48–56 to be operative. Preferably, this said relative acute angle (of either slit 48 or 50) is approximately equal to 15.

A bolt 52 extends transversely through a registering section of X-shaped disposed ovoidal slits 48 and 50. The opposite ends of bolt 52 carry two sleeves 54a, 54b integral to the ends of two corresponding legs 56a, 56b of an inversely U-shape yoke or pull bar 56. Washers 58a, 58b are provided between each sleeve 54a or 54b and the body of corresponding plates 28 or 30, and nuts 60a, 60b screwed to bolt 52 anchor the sleeves 54a, 54b in place. Pull bar 56 forms part of the above-noted connector means 44, with the bight of U-bar 56 being engaged by the arcuate hook H at the end of the hoisting cable C forming part of the known crane sling hoisting gear.

Operation of sling 24 can now be understood. When no load bias is applied by hoist cable C, nor by lever arms 32, 34, compensation bar 26 is free to slide telescopingly: the compensation bar can remain indifferently in a shortest-length, fully retracted condition (FIG. 8), or in a longest-length, fully extended condition (FIG. 8a), or indeed in an intermediate position illustrated in FIG. 1.

As hoist gear cable C lifts vertical U-bar 56, transverse shaft 52 is biased upwardly. Upward movement of shaft 52 is possible only if shaft 52 is allowed to slide slopewisely of ovoidal slit 48 in bar element 28. This slopewise motion will in turn be possible only if bar element 28 moves inwardly (retracts), as suggested by arrow 46 in FIG. 1. Because of the relative angle between the X-disposed slits 48 and 50, element 28 will be allowed to move inwardly only if shaft 52 is concurrently allowed to move up the slope of ovoidal slit 50 of bar element 30. Similarly, this slopewise sliding motion of shaft 52 along ovoidal slit 50 will be possible only if bar element 30 moves inwardly (retracts), as suggested by arrow 47 in FIG. 1.

Therefore, under lifting bias from cable C, transverse stud 52 will move slopewisely of ovoidal slits 48, 50, for a given travel distance short of the top ends 48a, 50a of ovoidal slits 48, 50. The total distance of travel of stud 52 toward top ends 48a, 50a is determined by the diameter of the transformer housing cover 16, against which will come to transversely abut the lever arms 32, 34. Indeed, as telescopic bar 26 progressively shortens with upward travel of stud 52 toward the ovoidal slits top ends 48a, 50a, lever arms 32, 34 are progressively drawn laterally inwardly toward the rim 16a of the enlarged housing cover 16. When lever arms 32, 34 do come in contact with cover 16, shortening of compensation bar 26 stops, i.e. stud 52 stops at a distance from the top ends 48*a*, 50*a* of the ovoidal slits. This is because the top ends of lever arms 32, 34 are prevented from pivoting inwardly, because of cotter pins 42 transversely abutting against the radially outer leg of the inversely U-shape sling securing hook member 42 of the transformer. Since lever seat action on rim 16*a* occurs on lever bodies 32, 34, at a position intermediate shafts 22 and 36, 38, compensation bar 26 will be prevented from further inward shortening motion. Additional load bias is thus applied directly against the body of transformer 14, to provide firm and tight interconnection between sling 24 and transformer 12.

It is thus understood that the operative position of stud 52 in ovoidal slits 48, 50, will come closer to top ends 48*a*, 50*a* of the ovoidal slits, for a diametrally small transformer 12, since compensation bar 26 will have to be telescopingly retracted by a substantial value; whereas stud 52 in ovoidal slits 48, 50 will remain closer to the bottom ends 48*b*, 50*b* of the ovoidal slits, for a diametrically larger transformer 12, since compensation bar 26 will have to be telescopingly extended by a substantial value for links 32, 34 to clear the periphery of transformer 12.

It is further understood that inward retraction of both elements 28, 30 of telescopic bar 26 is made in unison at exactly the same relative speed of displacement. This is the case, because the angle made by oblique ovoidal slit 48 relative to the lengthwise axis 45 of compensation bar 26, is exactly the same (e.g. 15°) as the angle made by oblique ovoidal slit 50 relative to axis 45. This ensures that shaft 52 remains centered within the plane of the center of gravity of load 14.

Lateral sway of the thus balanced transformer during its lift is thereby prevented. That is to say, even with transformers of varying diameters or weight, the sling means 24 will remain fully effective in tightly and firmly retaining the transformer, as well as in maintaining cable C, stud 52 and the center of gravity of load 14, vertically aligned for continuous stability during lift.

It is understood that the radially outward, downwardly extending free leg of the U-shape sling securing hook 22 of the transformer should be sufficiently long (as shown) to positively prevent accidental release of the link cotter pin 42, which engages the underface of the inversely U-shape hook 22, from the hook 22 and thus, from the transformer. Otherwise, nothing would prevent compensation bar from completely retracting under bias from hoist cable C, whatever the diameter of transformer 14.

Selection of the bores 40 in links 32, 34, for engagement by lock pins 42 is a matter in relation to the length of transformer 12: for a longer transformer, the selected bore 40 will be closer to the link outer free end 37, 39. Hence, as compensation bar 26 shortens by a value in proportion to the width of the transformer 12, the latter becomes firmly and tightly retained at its upper periphery by the assembly of link arms 32, 34 and U-hooks 22, under a biasing force in proportion to the weight of said transformer.

The transformer should of course be at least slightly larger diametrically than one bar 28 or 30 is long, for the self-adjustment means 48–52 of compensation bar 26 to be effective (i.e., for the lever arms 32, 34, to transversely seat against the transformer cover rim 16*a* intermediate of top pivots 36 or 38 and lower pivots 42).

Figure 6:
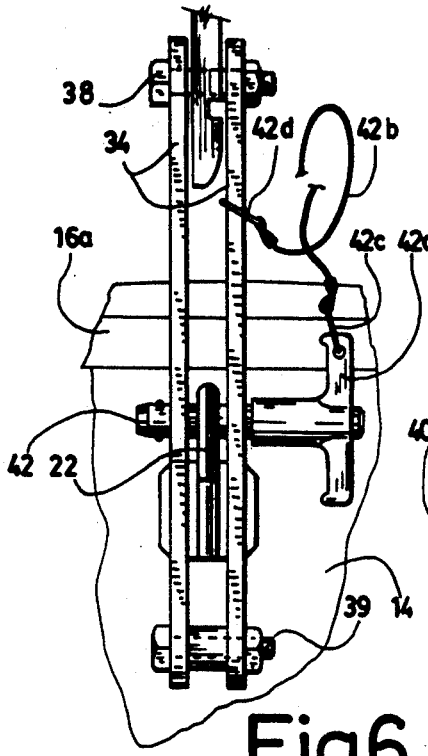
FIG. 6 is an edge view of the link arms of FIG. 5.
Figure 7:
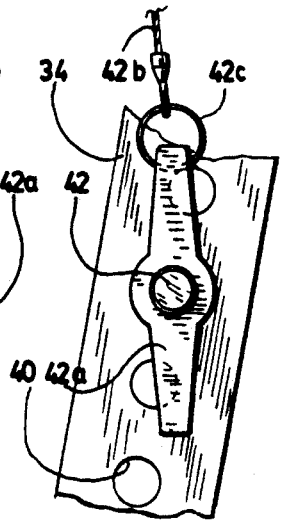
FIG. 7 is an enlarged, fragmentary view of the link arms from the side opposite FIG. 5, showing the lock pin.

Sling 24 is sturdy and durable. Since there is no cable that shears at the top flange edge 16*a* of transformer 12, as was undesirably the case with prior art transformer slings, accidental and brutal release of the suspended (heavy) transformer from the sling, in operation, is extremely unlikely, even after extensive use thereof. This is because the present sling 24 has a foolproof construction, so that even reckless use thereof would not lead to premature wear and eventual breakage thereof, meaning preventing a hazardous condition for workers.

preferably, each elongated ovoidal slit 48 or 50 has a length of about 8 inches, and a width of about 2 inches. Advantageously, and as illustrated in FIGS. 6–7, pin 42 is a cotter pin with an enlarged T-shape head 42*a*, for facilitating handling thereof. A loose cord 42*b* interconnects head 42*a* to one link arm 34 by end eyelets 42*c*, 42*d*, to retain cotter pin 42 loosely attached to links 34 even when released from the selected bore 40.

I claim:

1. A sling for use in lifting a transformer with a hoisting gear cable, said transformer of the type having a cylindrical housing with transverse, arcuate sling securing hooks mounted radially outwardly of the top end portion thereof, said sling consisting of:

(a) a telescopic, elongated compensation bar member, of adjustable overall length and extendable spacedly transversely over the top end of said cylindrical transformer, the pulling bias of said hoisting gear to be applied transversely of said compensation bar member;

(b) means for releasably suspending said compensation bar member to said hoist cable;

(c) first and second, rigid, lever members, pivotally carried at the two opposite ends of said compensation bar member, and for use in pivotally engaging said sling securing hooks on the transformer; and (d) an automatic adjusting means, cooperating with said suspending means and responsive to the pulling force applied by said hoisting gear cable, for automatically adjusting the length of said telescopic compensation bar member in proportion to the width of said transformer;

wherein said sling self-tightens against transformers of various widths, under the bias of said automatic adjusting means, by continuous lever action engagement of said lever members against the top end of said transformer cylindrical housing, under a tightening force in proportion to the weight of said transformer.

2. A sling as defined in claim 1, with said elongated compensation bar member consisting of first and second elongated bars, said bars slidingly interengaged for parallel sliding motion about their lengthwise axes; said automatic adjusting means including: two elongated slits, made at an intermediate location along the length of each one of said first and second bars, respectively, said bars slits being inclined toward opposite sides of said telescopic compensation bar member so as to form together an X-shape; a shaft, slidingly engaged transversely through said X-shaped disposed slits; and a yoke member defining two leg members the ends of which are transversely interconnected by said shaft; said yoke member adapted to depend from said hoisting gear;

wherein, under the pulling bias of said hoist cable, said transverse shaft moves upwardly slopewise of said slits thus, retracting said compensation bar member by a distance in proportion to the width of said transformer.

3. A sling as in claim 2, wherein the relative angle made between the lengthwise axes of said telescopic compensation bar member and that of any one of the two said slits, is identical for the two said slits.

4. A sling as in claim 3, wherein said slits relative angle is approximately 15°.

5. A sling as defined in claim 1, further including means for a adjusting said lever members to fit transformers of various lengths.

6. A sling as defined in claim 1, wherein said telescopic compensation bar member consists of two elongated first and second bars being the mirror image of one another, each said elongated bar defining first and second long edge portions, said first long edge portion being thin said second long edge portion of any one said elongated bar including an enlarged, cross-sectionally U-shape, inturned flange for sliding inner engagement by said first long edge portion of any other said elongated bar.

7. A sling as defined in claim 6, further including lengthwise ridge-and-groove track means, for guiding parallel relative lengthwise displacement of said compensation bars.

* * * * *